US008944982B2

(12) United States Patent
van der Kaap

(10) Patent No.: US 8,944,982 B2
(45) Date of Patent: Feb. 3, 2015

(54) DROP AND SLIDE MECHANISM FOR USE WITH DUNNAGE CONVERSION MACHINE AND METHOD

(75) Inventor: Jordy van der Kaap, Spaubeek (NL)

(73) Assignee: Ranpak Corp., Concord Township, OH (US)

( * ) Notice: Subject to any disclaimer, the term of this patent is extended or adjusted under 35 U.S.C. 154(b) by 672 days.

(21) Appl. No.: 13/258,726

(22) PCT Filed: May 4, 2010

(86) PCT No.: PCT/US2010/033563

§ 371 (c)(1),
(2), (4) Date: Sep. 22, 2011

(87) PCT Pub. No.: WO2010/129560

PCT Pub. Date: Nov. 11, 2010

(65) Prior Publication Data

US 2012/0015793 A1 Jan. 19, 2012

Related U.S. Application Data

(60) Provisional application No. 61/175,176, filed on May 4, 2009.

(51) Int. Cl.
*B31D 5/00* (2006.01)

(52) U.S. Cl.
CPC ..... *B31D 5/0047* (2013.01); *B31D 5/0039* (2013.01); *B31D 2205/007* (2013.01); *B31D 2205/0082* (2013.01)
USPC ..... 493/477; 493/464; 493/350

(58) Field of Classification Search
CPC ..... B31D 2205/0023; B31D 2205/0029; B31D 2205/0035; B31D 2205/0082; B31D 5/00; B31D 5/0039; B31D 5/0047; B31D 5/0043; B65B 55/20
USPC ..... 493/350, 477, 464, 967, 904, 459
See application file for complete search history.

(56) References Cited

U.S. PATENT DOCUMENTS 4,026,198 A * 5/1977 Ottaviano ..... 493/357
4,085,662 A * 4/1978 Ottaviano ..... 493/354

(Continued)

FOREIGN PATENT DOCUMENTS

FR 2 798 981 3/2001

OTHER PUBLICATIONS

International Search Report and Written Opinion of corresponding International Application No. PCT/US2010/033563, dated Aug. 17, 2010.

*Primary Examiner* — Hemant M Desai
*Assistant Examiner* — Eduardo R Ferrero
(74) *Attorney, Agent, or Firm* — Renner, Otto, Boisselle & Sklar, LLP

(57) ABSTRACT

An apparatus comprising a dunnage conversion machine (30) for converting a stock material into a dunnage product, a stock material support (22) for a supply of stock material to be fed to the dunnage conversion machine, and a drop-and-slide mechanism (34) configured to allow the stock material support to be moved between an operating position and a loading position, which is spaced both horizontally and vertically from the operating position. The drop-and-slide mechanism includes a guide member (40) and a slide (42) to which the stock material support is mounted. The slide is supported by the guide member for horizontal movement relative to the guide member. A packer can pull the slide horizontally away from the operating position, causing the stock support to fall to the loading position, and the packer can push the slide away from the loading position, causing the stock support to rise to the operating position.

16 Claims, 7 Drawing Sheets

(56) References Cited

U.S. PATENT DOCUMENTS

| | | | | |
|---|---|---|---|---|
| 4,237,776 | A * | 12/1980 | Ottaviano | 493/382 |
| 5,387,173 | A * | 2/1995 | Simmons, Jr. | 493/407 |
| 5,487,717 | A | 1/1996 | Tekavec et al. | |
| 5,730,696 | A * | 3/1998 | Simmons | 493/478 |
| 5,803,893 | A * | 9/1998 | Armington et al. | 493/477 |
| 5,882,767 | A * | 3/1999 | Simmons, Jr. | 428/126 |
| 5,891,010 | A * | 4/1999 | Kobben et al. | 493/478 |
| 6,077,209 | A | 6/2000 | Armington et al. | |
| 6,402,674 | B1 * | 6/2002 | Simmons et al. | 493/24 |
| 6,471,154 | B1 * | 10/2002 | Toth | 242/421.3 |
| 6,676,589 | B2 * | 1/2004 | Kung et al. | 493/464 |
| 6,910,997 | B1 * | 6/2005 | Yampolsky et al. | 493/464 |
| 7,022,060 | B2 * | 4/2006 | Toth | 493/464 |
| 7,186,208 | B2 * | 3/2007 | Demers et al. | 493/350 |
| 7,614,994 | B2 * | 11/2009 | Harding et al. | 493/464 |
| 7,744,519 | B2 * | 6/2010 | Wetsch et al. | 493/464 |
| 7,771,338 | B2 * | 8/2010 | Wetsch et al. | 493/464 |
| 8,419,606 | B2 * | 4/2013 | Carlson et al. | 493/464 |
| 2002/0119876 | A1 * | 8/2002 | Lu et al. | 493/350 |
| 2004/0043883 | A1 * | 3/2004 | Toth | 493/464 |
| 2004/0142806 | A1 * | 7/2004 | Coppus et al. | 493/350 |
| 2004/0192531 | A1 * | 9/2004 | Meessen | 493/350 |
| 2005/0215408 | A1 * | 9/2005 | Yampolsky et al. | 493/464 |
| 2007/0066472 | A1 * | 3/2007 | Harding et al. | 493/350 |
| 2007/0287623 | A1 * | 12/2007 | Carlson et al. | 493/464 |
| 2008/0076654 | A1 | 3/2008 | Riga et al. | |
| 2008/0207421 | A1 * | 8/2008 | Wetsch et al. | 493/464 |
| 2009/0082187 | A1 * | 3/2009 | Cheich et al. | 493/350 |
| 2009/0098996 | A1 * | 4/2009 | Metta et al. | 493/464 |
| 2009/0258775 | A1 * | 10/2009 | Chan et al. | 493/464 |
| 2010/0160132 | A1 * | 6/2010 | Cheich | 493/340 |
| 2010/0331161 | A1 * | 12/2010 | Wetsch et al. | 493/464 |
| 2011/0053749 | A1 * | 3/2011 | Wetsch et al. | 493/464 |
| 2011/0053750 | A1 * | 3/2011 | Wetsch et al. | 493/464 |
| 2012/0015793 | A1 * | 1/2012 | van der Kaap | 493/477 |

* cited by examiner

DROP AND SLIDE MECHANISM FOR USE WITH DUNNAGE CONVERSION MACHINE AND METHOD

This application is a national phase of International Application No. PCT/US2010/033563, filed May 4, 2010, and published in English as WO 2010/129560, which claims the benefit of U.S. Provisional Patent Application No. 61/175,176, filed May 4, 2009, which are incorporated herein by reference.

FIELD OF THE INVENTION

The present invention is related to the field of dunnage conversion machines, and more particularly to a dunnage conversion machine and method with a movable stock material support.

BACKGROUND

Dunnage conversion machines convert a stock material into a dunnage product. Dunnage products are used for packaging articles in boxes so that the articles do not move around during shipment. One type of dunnage conversion machine converts a sheet stock material, such as paper, into a relatively thicker and less dense dunnage product as the stock material moves from an upstream end of the machine to a downstream end of the machine. Exemplary dunnage conversion machines of this type include those shown and described in the following patent documents: U.S. Pat. Nos. 6,077,209; 5,487,717; 5,803,893; and 7,186,208.

The stock material typically is supported either on a frame extending from an upstream end of the machine or on a separate stand or cart that can be positioned to feed the stock material to the upstream end of the machine. Sometimes a conversion machine will be supported above a work surface, such as a table or a conveyor, to dispense dunnage toward the work surface for use by the packer. The support for the stock material to be fed to the conversion machine also can be elevated above the work surface, or the stock material can be supported on a stand or cart located on an opposite side of the work surface from the packer.

SUMMARY OF THE INVENTION

When the supply of stock material is located on an opposite side of the work surface from the packer, it can be difficult or time-consuming for the packer to replenish the supply. When a dunnage conversion machine or a supply of stock material are mounted above the work surface, the elevated position can make it difficult to access the conversion machine and/or stock material supply to inspect and repair the machine or to replenish the supply of stock material. The invention described in the following paragraphs makes it easier to access an elevated dunnage conversion machine or supply of stock material.

An exemplary apparatus provided by the invention comprises a dunnage conversion machine for converting a stock material into a dunnage product, a stock material support for a supply of stock material to be fed to the dunnage conversion machine, and a drop-and-slide mechanism. The drop-and-slide mechanism is configured to allow the stock material support to be moved between an operating position and a loading position that is spaced horizontally and vertically from the operating position. The drop-and-slide mechanism includes a guide member and a slide to which the stock material support is mounted. And the slide is supported by the guide member for horizontal movement relative to the guide member.

An exemplary method for loading stock material from a stock material support to a dunnage conversion machine that uses a drop-and-slide mechanism having a guide member and a slide to which the stock material support is mounted, comprises the following steps:

(a) horizontally moving the slide relative to the guide member to move the stock material support from an operating position toward a loading position, whereby the stock material support also moves vertically downward from the operating position to the loading position;

(b) loading a supply of stock material onto the stock material support; and (c) horizontally moving the slide relative to the guide member to move the stock material support from the loading position toward the operating position.

Another exemplary apparatus for supporting a stock material for a dunnage conversion machine, comprises a stock material support and means for supporting the stock material support for movement between an operating position and a loading position. The operating position is vertically and horizontally spaced from the loading position, and the means for supporting includes a guide member and a slide to which the stock material support is mounted for horizontal movement relative to the guide member.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figure 1:
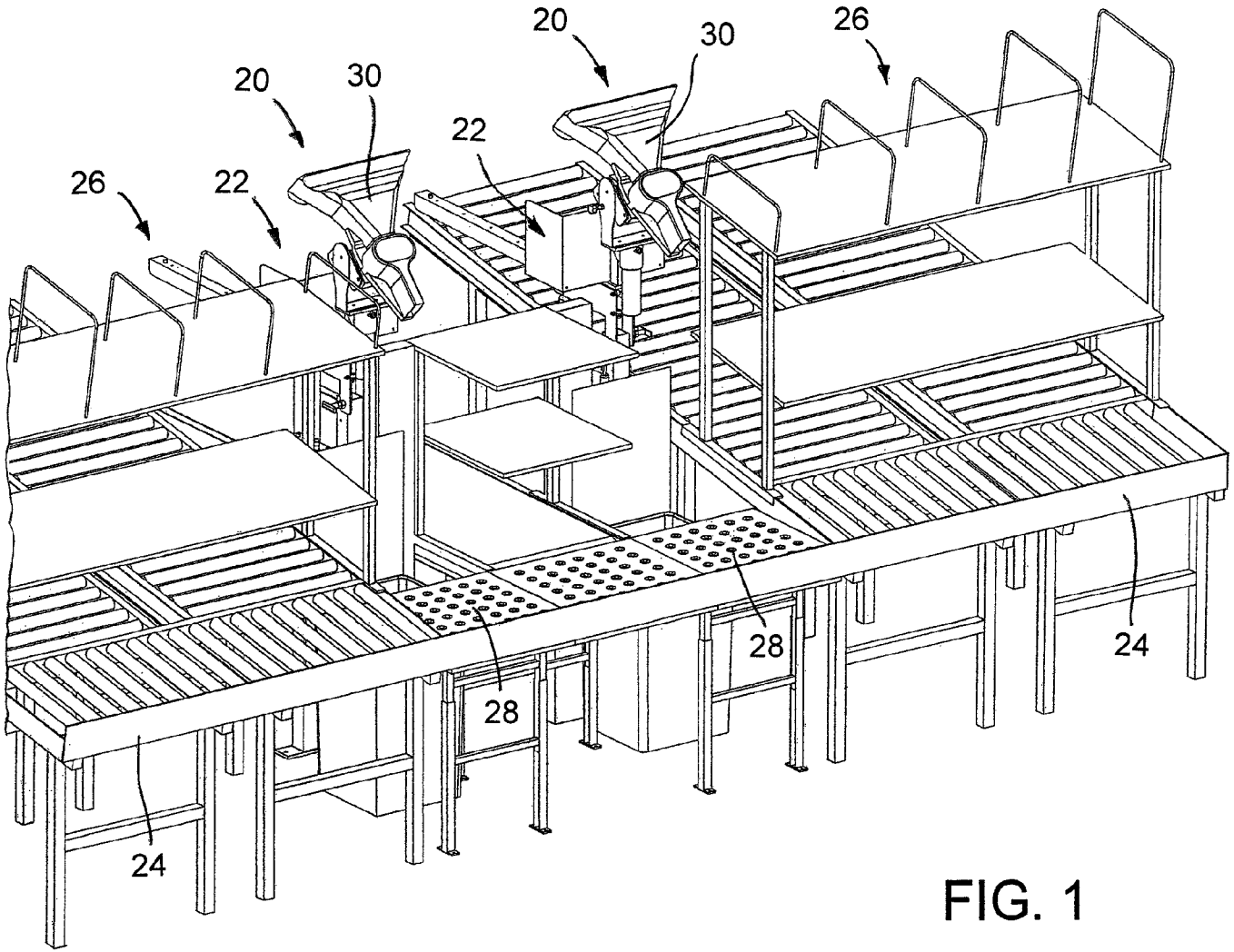
FIG. 1 is a perspective view of two packing stations, each of which includes a dunnage conversion machine and a drop-and-slide mechanism in accordance with the present invention and a stock material support shown in an operating position.
Figure 2:
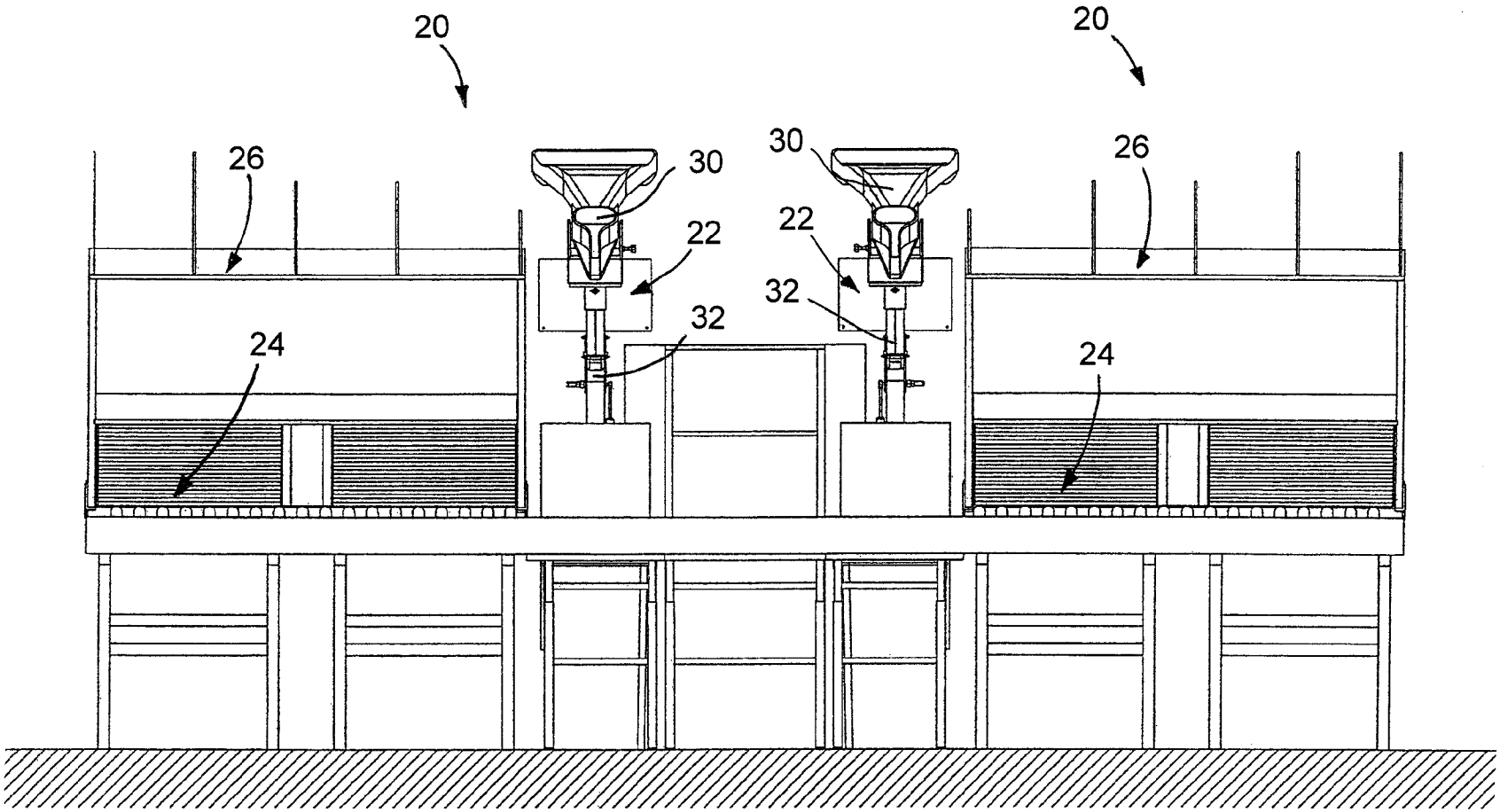
FIG. 2 is a front elevation view of the packaging stations of FIG. 1.
Figure 3:
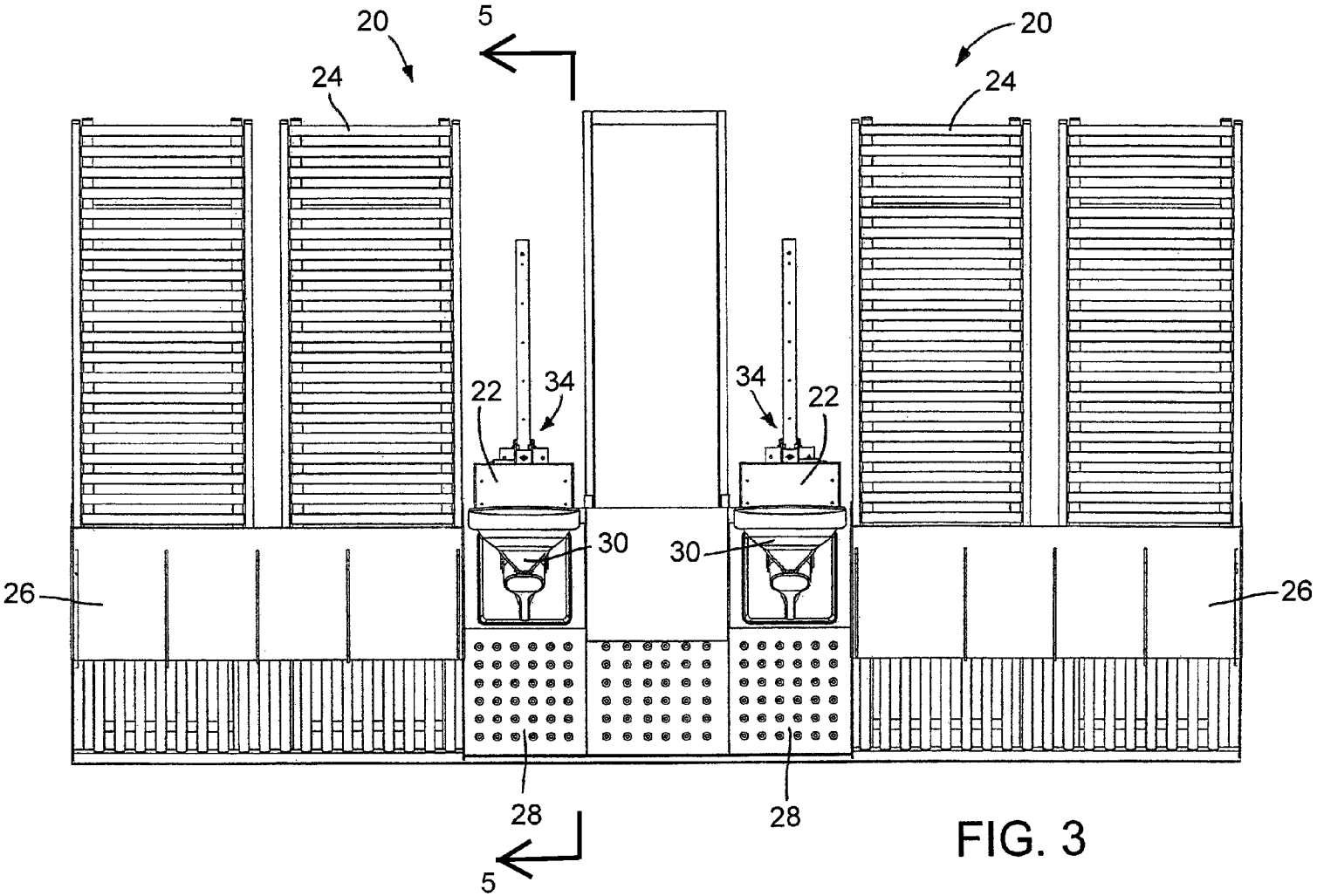
FIG. 3 is a top view of the packaging stations of FIG. 1.
Figure 4:
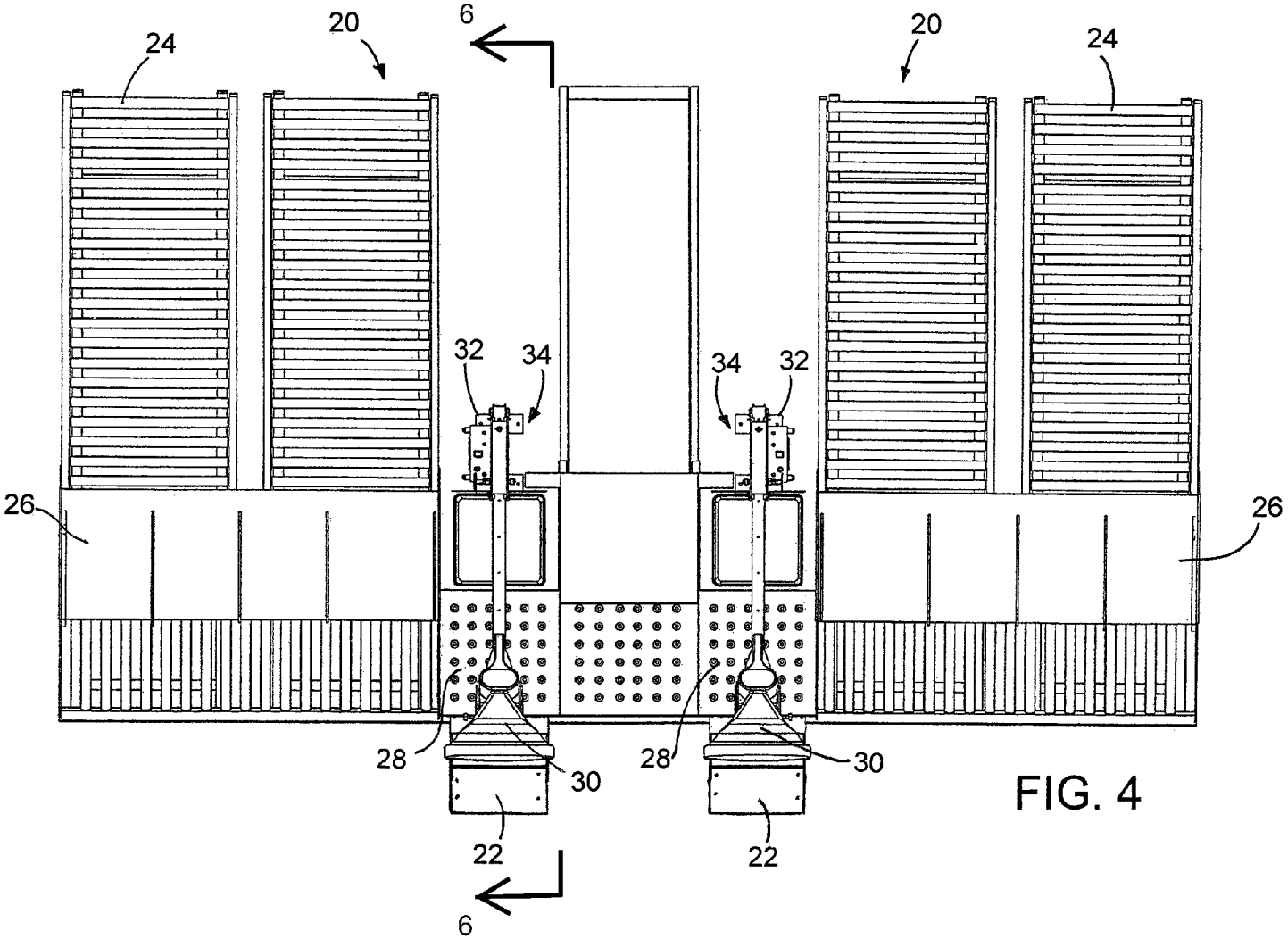
FIG. 4 is a top view of the packaging stations of FIG. 4, with the stock material supports in a loading position.
Figure 6:
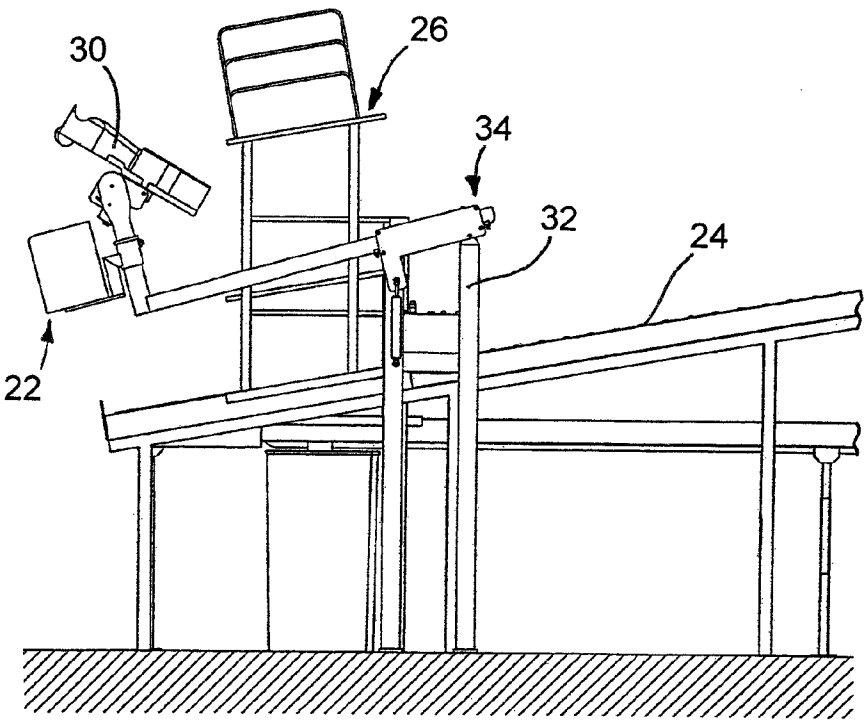
FIG. 6 is a side elevation view of the stock material support in the loading position as seen along lines 6-6 of FIG. 4.
Figure 5:
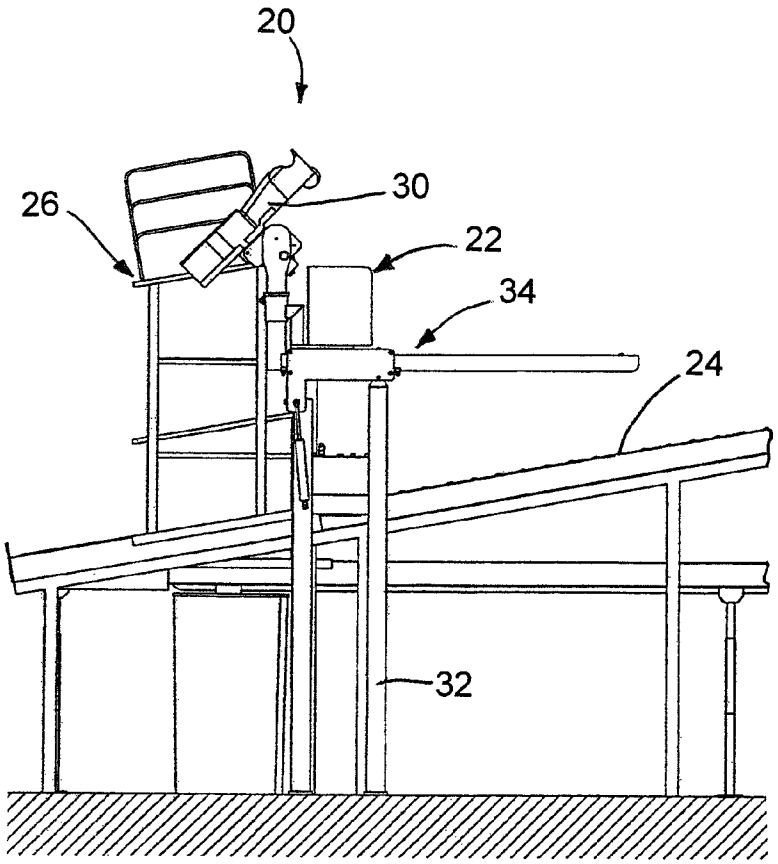
FIG. 5 is a side elevation view of the stock material support in the operating position as seen along lines 5-5 of FIG. 3.
Figure 7:
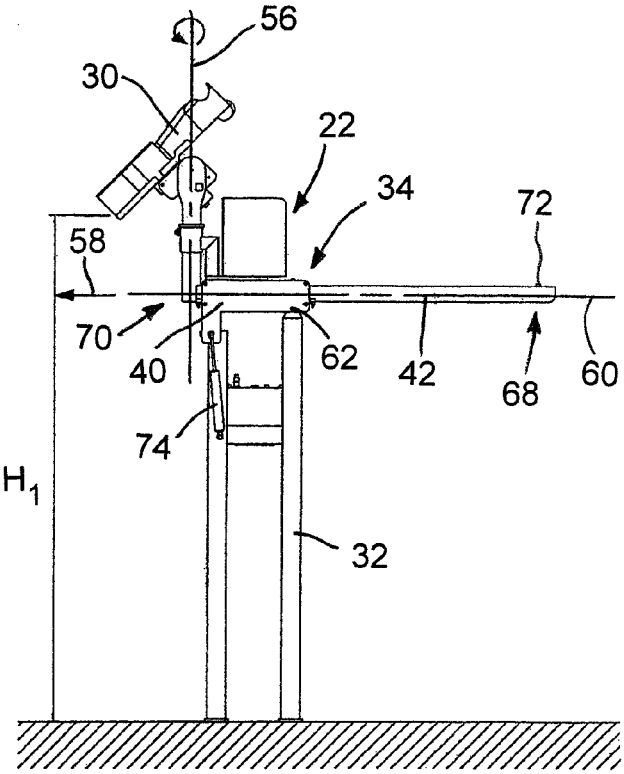
FIG. 7 is another side elevation view of a dunnage conversion machine and drop-and-slide mechanism with a stock material support in an operating position.

The present invention provides a way to inspect or load a supply of stock material for a dunnage conversion machine when the support for the stock material supply is mounted at an elevated position above a work surface, such as a conveyor or a table. The conversion machine, also referred to as a converter, typically is mounted about head-high above the work surface to dispense dunnage downward to a box or other container. To load the supply of stock material, the packer pulls the stock material support forward, which causes the stock material support to drop to a loading position where the stock material support is lower and closer to the packer. When pulled forward, the weight of the stock material support extended on a slide overcomes an upward bias to lower the stock material support to a more convenient height closer to the packer for loading, inspection, maintenance, repair, etc. When the packer pushes the stock material support back, away from the packer, a biasing device raises the stock material support back to an operating position.

FIGS. 1-6 illustrates an exemplary arrangement for a packing station 20 employing a stock material support 22 in accordance with the present invention. In FIGS. 1-6, two packing stations 20 are shown side-by-side. Each packing station 20 includes conveyors 24 for delivering items to a packer, shelves 26 for storing packing supplies, a packing work surface 28 adjacent a dunnage conversion machine 30, and a stock material support 22 that supports a stock material to feed the dunnage conversion machine or converter 30. The work surface 28 can support a container in a position to receive dunnage from the converter 30. Each converter 30 is mounted in an elevated location adjacent the work surface 28 by a frame 32.

Each converter 30 also is supported from an opposing side of the work surface 28 from the packer, which makes it more difficult for the packer to access the converter 30 and the stock material support 22. Accordingly, an exemplary apparatus provided by the invention comprises a dunnage conversion machine 30 for converting a stock material into a dunnage product, a stock material support 22 for a supply of stock material to be fed to the dunnage conversion machine 22, and a drop-and-slide mechanism 34 that is configured to allow the stock material support 22 to be moved between an operating position (FIG. 5) and a loading position (FIG. 6), which is spaced both horizontally and vertically from the operating position. This allows the packer to access the converter 30 and the stock material support 22 from the near side of the work surface 28.

Turning to FIGS. 7-10, the drop-and-slide mechanism 34 includes a guide member 40 and a slide 42 to which the stock material support 22 is mounted. The slide 42 is supported by the guide member 40 for horizontal movement relative to the guide member 40. Thus the packer can reach across the work surface 28 and pull the slide 42 forward, across the work surface 28 (FIG. 4) so that the packer can access the stock material support 22. Thus the packer can replenish the supply of stock material, and feed it to the converter 30, for example.

Although this invention is not limited to a particular type of converter, an exemplary converter 30 is described in U.S. Pat. No. 7,186,208, for example. The converter 30 converts a stock material into a relatively thicker and less dense dunnage product. An exemplary stock material includes a sheet stock material, and particularly paper. The paper may be provided in the form of a roll or as a fan-folded stack.

In the illustrated apparatus the stock material support 22 includes a shelf 44 for supporting a stack of fan-folded sheet stock material. The sheet stock material may include one or more plies folded to form a generally rectangular stack. In addition to a bottom support surface 46, the shelf 44 includes a relatively low front side wall 48 and relatively higher left, right, and back side walls 50, 52, and 54 to help support the stack and prevent it from falling over.

In this embodiment both the stock material support 22 and the dunnage conversion machine 30 are mounted to the slide 42 for rotation relative to the slide 42 about an axis of rotation 56 transverse a horizontal direction of movement of the slide 42. With the stock material support 22 in the operating position (FIG. 7), the axis of rotation 56 is substantially vertical and at least a portion of the slide has a length dimension, measured along a longitudinal axis 60 of the slide 42, that is oriented substantially horizontal. This rotation allows the converter 30 and the stock material support 22 to be selectively rotated toward the packer to inspect or repair the converter 30, clear jams, or replenish the supply of stock material.

Figure 9:
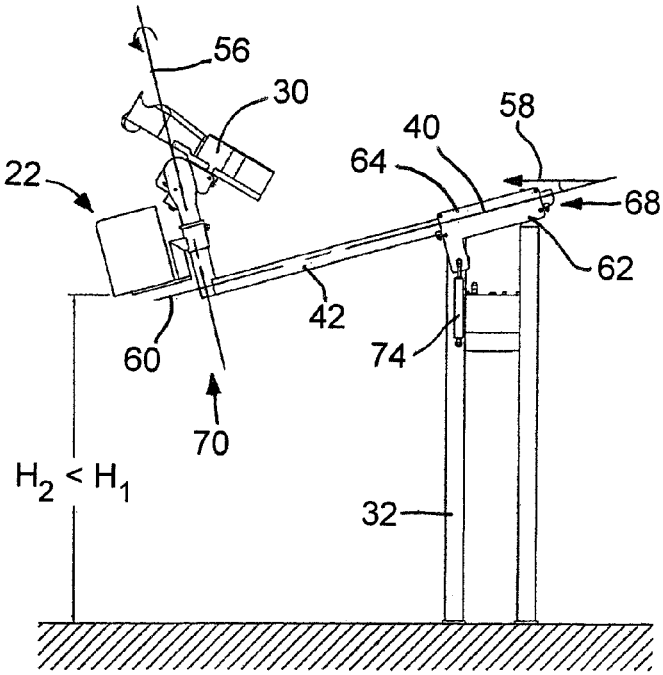
FIG. 9 is another side elevation view of a dunnage conversion machine and drop-and-slide mechanism with a stock material support in a loading position.

The slide 42 is movable parallel to the length dimension and is rotatable about a substantially horizontal pivot axis 62 transverse the length dimension. In the illustrated embodiment, the guide member 40 is pivotable about this substantially horizontal axis 62 at a pivot point where the guide member 40 is supported by the frame 32. The illustrated guide member 40 includes a tubular sleeve 64 with a cross-section that is configured to capture the slide within. Accordingly, the guide member 40 constrains the movement of the slide 42 to movement parallel to the longitudinal axis of the slide 42, such that the slide is telescopically movable relative to the guide member 40 in this embodiment. The longitudinal axis 60 of the slide 42 is substantially horizontal when the stock material support 22 is in the operating position (FIG. 7) and inclined relative to horizontal when the stock material support 22 is in the loading position (FIG. 9).

The slide-and-drop mechanism 34 provides a slide motion whereby the slide 42 can move relative to the guide member 40 while remaining in contact with the guide member 40, via a frictional action or a rolling action, for example. Thus the slide 42 or the guide member 40 may be equipped with rollers so that the slide motion can be provided through rolling contact with the rollers connecting the slide to the guide member. To that end, the illustrated guide member 40 includes rollers 66 to help the slide 42 move relative to the guide member 40.

To help describe the vertical movement of the stock material support 22, consider that the slide 42 has a stop end 68 and a support end 70 opposite the stop end 68, and the stock material support 22 is mounted to the support end 70 of the slide 42. The slide 42 also includes a stop 72 at the stop end 68 to define the maximum extension of the slide 42 relative to the guide member 40 and thus helps to define the loading position. In the operating position, the slide 42 is retracted so that the support end 70 of the slide 42 is closer to the guide member 40. When the stock material support 22 is in the operating position (FIG. 8), the support end 70 is relatively closer to the guide member 40 than when the stock material support 22 is in the loading position (FIG. 10).

The drop-and-slide mechanism 34 also includes a biasing device 74 that biases the stock material support 22 toward the operating position. When the support end 70 of the slide 42 is moved toward the guide member 40, the biasing device 74 rotates the guide member 40 to raise the stock material support 22 to the operating position. An exemplary biasing device 74 includes a spring, such as a gas spring.

When the support end 70 of the slide 42 is moved away from the guide member 40, the guide member 40 rotates about the substantially horizontal pivot axis 62 to lower the stock material support 22 toward the loading position. After the stock material support 22 moves from the operating position, the stock material support 22 and the slide 42 have a weight distribution that is sufficient to overcome the upward urging of the biasing device 74, causing the guide member 40 to rotate the stock material support downward. The sliding action moving the slide 42 relative to the guide member 40 leads to the tilting action at the pivot axis 62 due to the change in the weight distribution along the longitudinal axis of the slide 42 relative to the pivot point at the pivot axis 62. The biasing device has sufficient strength to upwardly bias the stock material support 22 to the operating position, however, when the stock material support 22 is in the operating position loaded with a supply of stock material.

Figure 8:
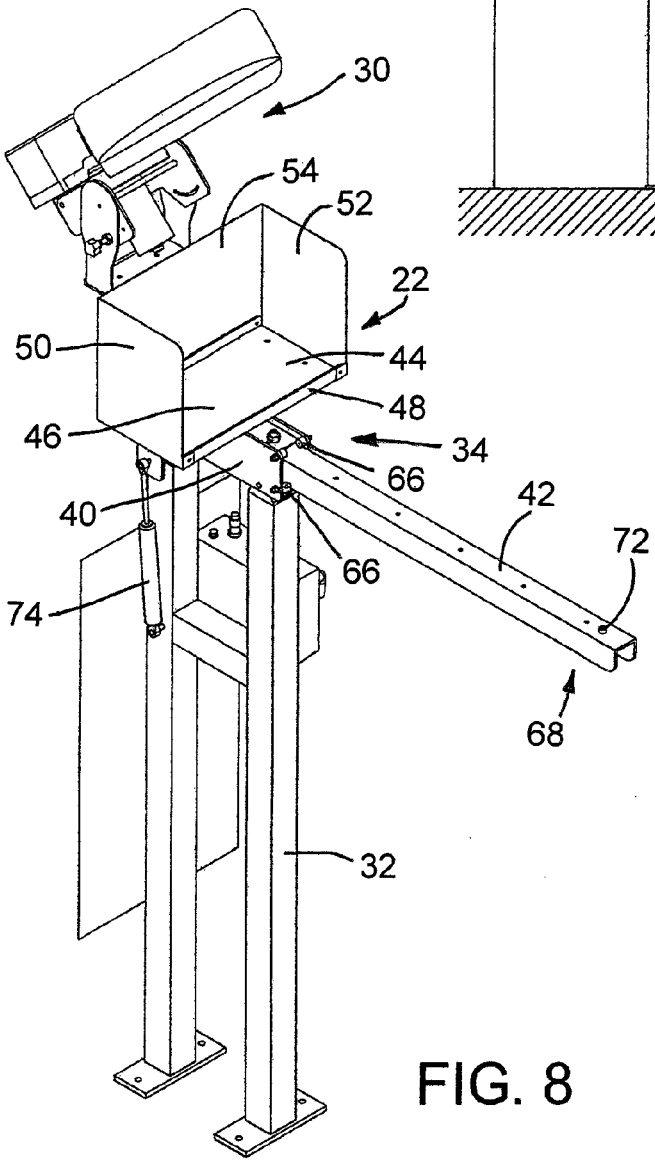
FIG. 8 is a perspective view of the dunnage conversion machine and drop-and-slide mechanism of FIG. 7.
Figure 10:
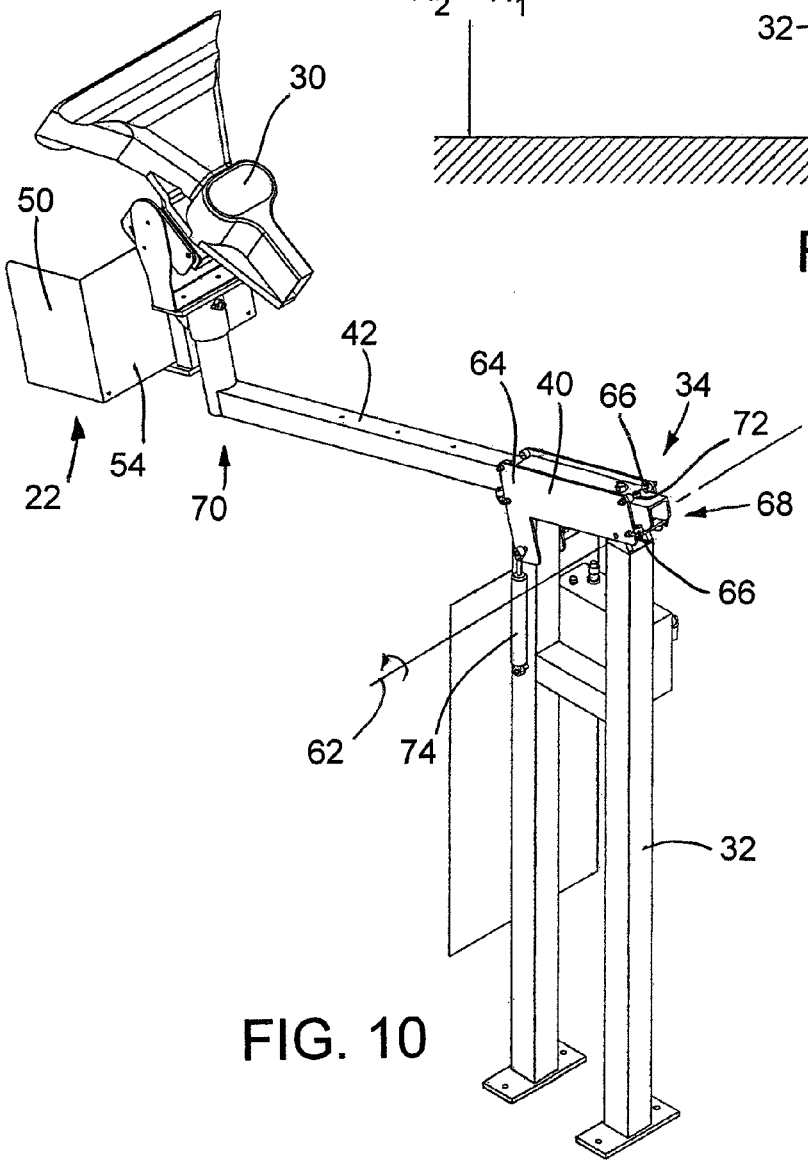
FIG. 10 is a perspective view of the dunnage conversion machine and drop-and-slide mechanism of FIG. 9.

Accordingly, the slide 42 is movable between a retracted position that helps to define the operating position for the stock material support 22 (as shown in FIG. 8) and an extended position which helps define the loading position for the stock material support 22 (as shown in FIG. 10). The biasing device 74 is mounted between the frame 32 and the guide member 40, and the guide member 40 in turn supports the slide 42, which in turn supports the stock material support 22 and/or the converter 30.

In this embodiment, the converter 30 also moves with the stock material support 22 on the slide 42. Alternatively, the converter 30 can be mounted to a separate support structure and the stock material support 22 can move with the slide 42 on its own.

An exemplary method for loading stock material from a stock material support 22 to a dunnage conversion machine 30 using a drop-and-slide mechanism 30 comprises the following steps: (a) horizontally moving the slide 42 relative to the guide member 40 to move the stock material support 22 from an operating position toward a loading position, whereby the stock material support 22 moves vertically downward from the operating position to the loading position; (b) loading a supply of stock material onto the stock material support 22; and (c) horizontally moving the slide 42 relative to the guide member 40 to move the stock material support 22 from the loading position toward the operating position. In other words, the packer pulls the slide 42 horizontally toward himself or herself across the work surface 28, which causes the stock material support 22 to fall to the loading position, and then the packer pushes the slide 42 back across the work surface 28, which causes the stock material support to rise back to the operating position.

The weight of the stock material support 22 and any stock material it supports, the weight of the slide 42, and/or the weight of the converter 30 cooperate with the biasing device 74 to raise and lower the stock material support 22 between the loading position and the operating position. As the stock material support 22 moves further from the guide member 40 and its pivot axis 56, the slide 42 acts as a lever applied by the weight to overcome the upwardly-directed biasing force applied by the biasing device 74.

In summary, my invention provides an apparatus comprising a dunnage conversion machine 30 for converting a stock material into a dunnage product, a stock material support 22 for a supply of stock material to be fed to the dunnage conversion machine, and a drop-and-slide mechanism 34 configured to allow the stock material support to be moved between an operating position and a loading position, which is spaced both horizontally and vertically from the operating position. The drop-and-slide mechanism includes a guide member 40 and a slide 42 to which the stock material support is mounted. The slide is supported by the guide member for horizontal movement relative to the guide member. A packer can pull the slide horizontally away from the operating position, causing the stock support to fall to the loading position, and the packer can push the slide away from the loading position, causing the stock support to rise to the operating position.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

I claim:

1. An apparatus comprising a dunnage conversion machine for converting a stock material into a dunnage product, a stock material support for a supply of stock material to be fed to the dunnage conversion machine, and a drop-and-slide mechanism, where the drop-and-slide mechanism is configured to allow the stock material support to be moved between an operating position and a loading position that is spaced horizontally and vertically from the operating position, where the drop-and-slide mechanism includes a guide member and a slide to which the stock material support is mounted, the slide having a longitudinal axis and being supported by the guide member for movement relative to the guide member in a direction parallel to the longitudinal axis, the guide member being rotatable about a horizontal axis perpendicular to the longitudinal axis of the slide such that in the operating position the longitudinal axis of the slide is horizontal and in the loading position the longitudinal axis of the slide lies at an oblique angle to the horizontal.

2. An apparatus as set forth in claim 1, where the dunnage conversion machine converts a sheet stock material into a relatively thicker and less dense dunnage product.

3. An apparatus as set forth in claim 1, where the stock material support includes a shelf for supporting a stack of fan-folded sheet stock material.

4. An apparatus as set forth in claim 1, where the stock material support is rotatable relative to the slide about an axis perpendicular to the direction of movement of the slide.

5. An apparatus as set forth in claim 1, where the longitudinal axis of the slide is horizontal when the stock support is in the operating position.

6. An apparatus as set forth in claim 5, where the slide is movable along its longitudinal axis and rotatable about a horizontal axis perpendicular to said longitudinal axis.

7. An apparatus as set forth in claim 1, where the guide member is pivotable about a horizontal axis.

8. An apparatus as set forth in claim 7, where the slide is slidingly movable along the guide member.

9. An apparatus as set forth in claim 7, where the guide member constrains the movement of the slide to movement parallel to a longitudinal axis of the slide.

10. An apparatus as set forth in claim 7, where the slide has a free end and a support end opposite the free end, and the stock material support is mounted to the support end of the slide, and when the stock material support is in the operating position the support end is relatively closer to the guide member than when the stock material support is in the loading position.

11. An apparatus as set forth in claim 7, where the slide has a free end and a support end opposite the free end, and the stock material support is mounted to the support end of the slide, and when the support end is moved away from the guide member, the guide member rotates to lower the stock material support toward the loading position, and when the support end is moved toward the guide member, the guide member rotates to raise the stock material support to the operating position.

12. An apparatus as set forth in claim 7, where the stock material support is rotatable relative to the slide about an axis that is perpendicular to a longitudinal axis of the slide.

13. An apparatus as set forth in claim 7, where the guide member includes a sleeve with a cross-section that is configured to capture the slide within.

14. An apparatus as set forth in claim 6, where the drop-and-slide mechanism includes a biasing device that biases the stock material support toward the operating position.

15. An apparatus as set forth in claim 14, where the biasing device includes a spring.

16. An apparatus as set forth in claim 14, where the stock material support and the slide have a weight distribution that is sufficient to overcome the upward urging of the biasing device after the stock material support is moved from the operating position.

* * * * *